United States Patent [19]

Larrea

[11] 4,026,249

[45] May 31, 1977

[54] ROTARY CYCLOIDAL CONTINUOUS TOROIDAL CHAMBER INTERNAL COMBUSTION ENGINE

[76] Inventor: Carlos Ayesta Larrea, Zurbaran, 43 - Bilbao, Spain

[22] Filed: Nov. 19, 1975

[21] Appl. No.: 633,251

Related U.S. Application Data

[63] Continuation of Ser. No. 450,194, March 11, 1974, abandoned.

[30] Foreign Application Priority Data

Mar. 14, 1973 Spain ..... 412626

[52] U.S. Cl. ..... 123/8.47; 418/36

[51] Int. Cl.[2] ..... F02B 53/00

[58] Field of Search ..... 123/8.47; 418/36

[56] References Cited

UNITED STATES PATENTS

| | | | |
|---|---|---|---|
| 1,452,125 | 4/1923 | Pont | 123/8.47 |
| 1,568,052 | 1/1926 | Bullington | 418/36 |
| 1,665,581 | 4/1928 | Deny | 123/8.47 |
| 1,726,461 | 8/1929 | Weed | 123/8.47 |
| 1,973,397 | 9/1934 | Stromberg | 123/8.47 |
| 2,126,795 | 8/1934 | McIntyre | 123/8.47 |
| 3,256,866 | 6/1966 | Bauer | 123/8.47 |
| 3,299,865 | 1/1967 | Moyer | 123/8.47 X |
| 3,385,272 | 5/1968 | Winogrodzki et al. | 418/36 X |
| 3,396,632 | 8/1968 | Leblanc | 418/36 |
| 3,890,939 | 6/1975 | McIntosh | 418/36 X |

FOREIGN PATENTS OR APPLICATIONS

| | | | |
|---|---|---|---|
| 1,965,865 | 5/1971 | Germany | 123/8.47 |

*Primary Examiner*—William L. Freeh
*Assistant Examiner*—Michael Koczo, Jr.
*Attorney, Agent, or Firm*—Eyre, Mann, Lucas & Just

[57] ABSTRACT

A rotary internal combustion engine block has a toroidal combustion chamber of circular section. At least four pistons fitted in said chamber perform discontinuous unidirectional circular motion about the center of the toroidal combustion chamber. At various stations about the torus, an air-fuel mixture is introduced between adjacent pistons, the adjacent pistons approach each other resulting in compression of the air-fuel mixture, the mixture is ignited, and gas expansion drives the adjacent pistons apart. The mechanical energy of the pistons being moved apart by the gas expansion is coupled through a drive shaft to the load.

10 Claims, 31 Drawing Figures

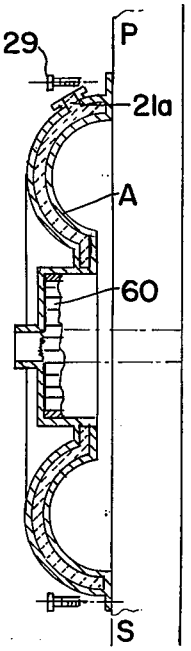
Fig. 29
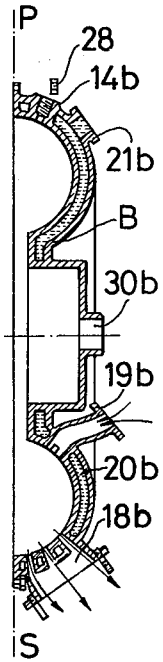
Fig. 7
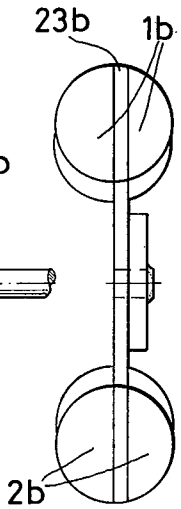
Fig. 6
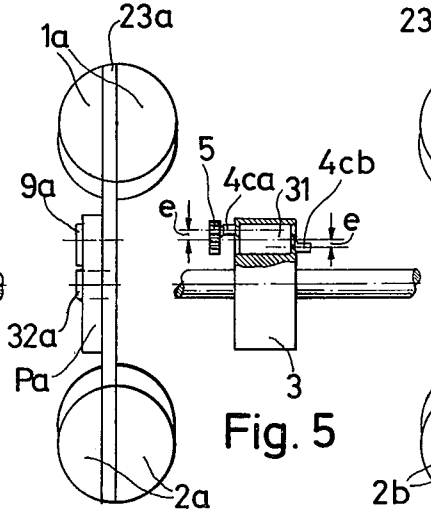
Fig. 5
Fig. 4
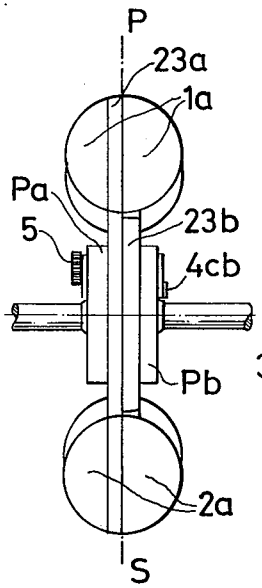
Fig. 3
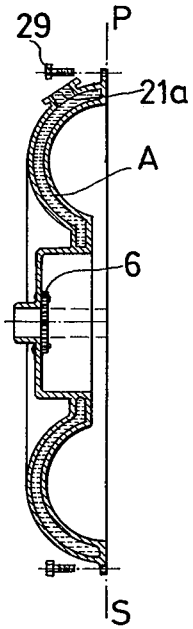
Fig. 2

Fig. 13
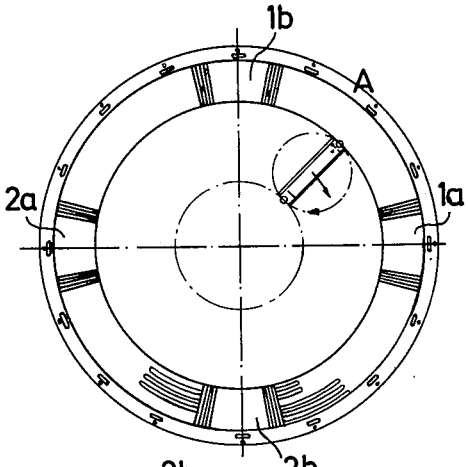
Fig. 14
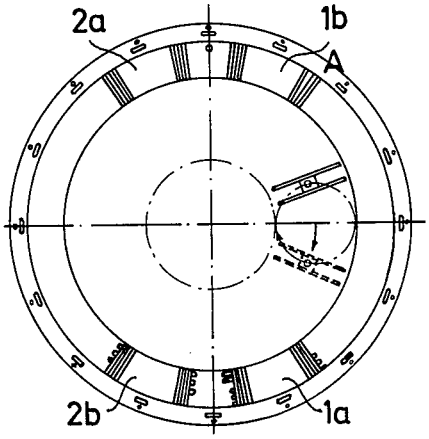
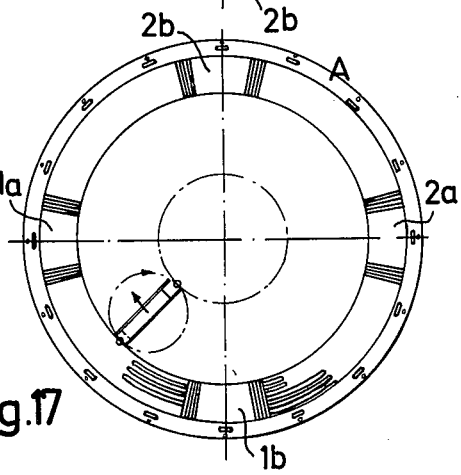
Fig.17
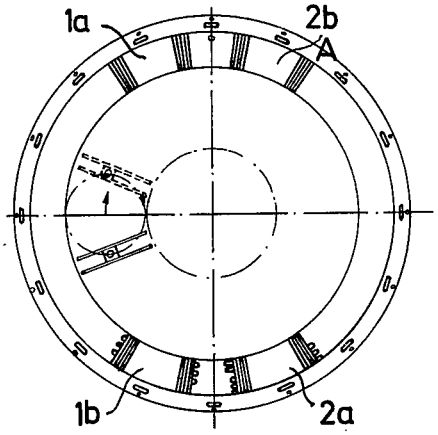
Fig. 18
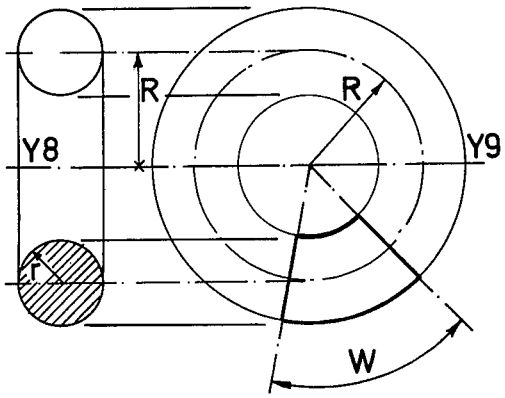
Fig. 21

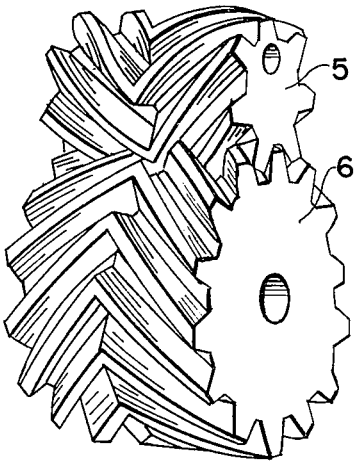
Fig. 31
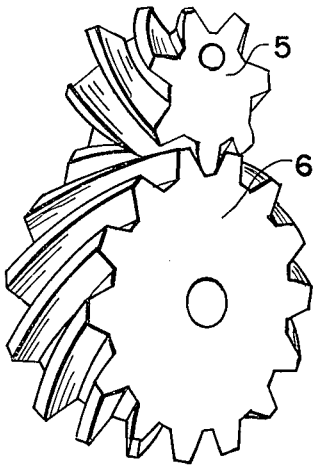
Fig. 30
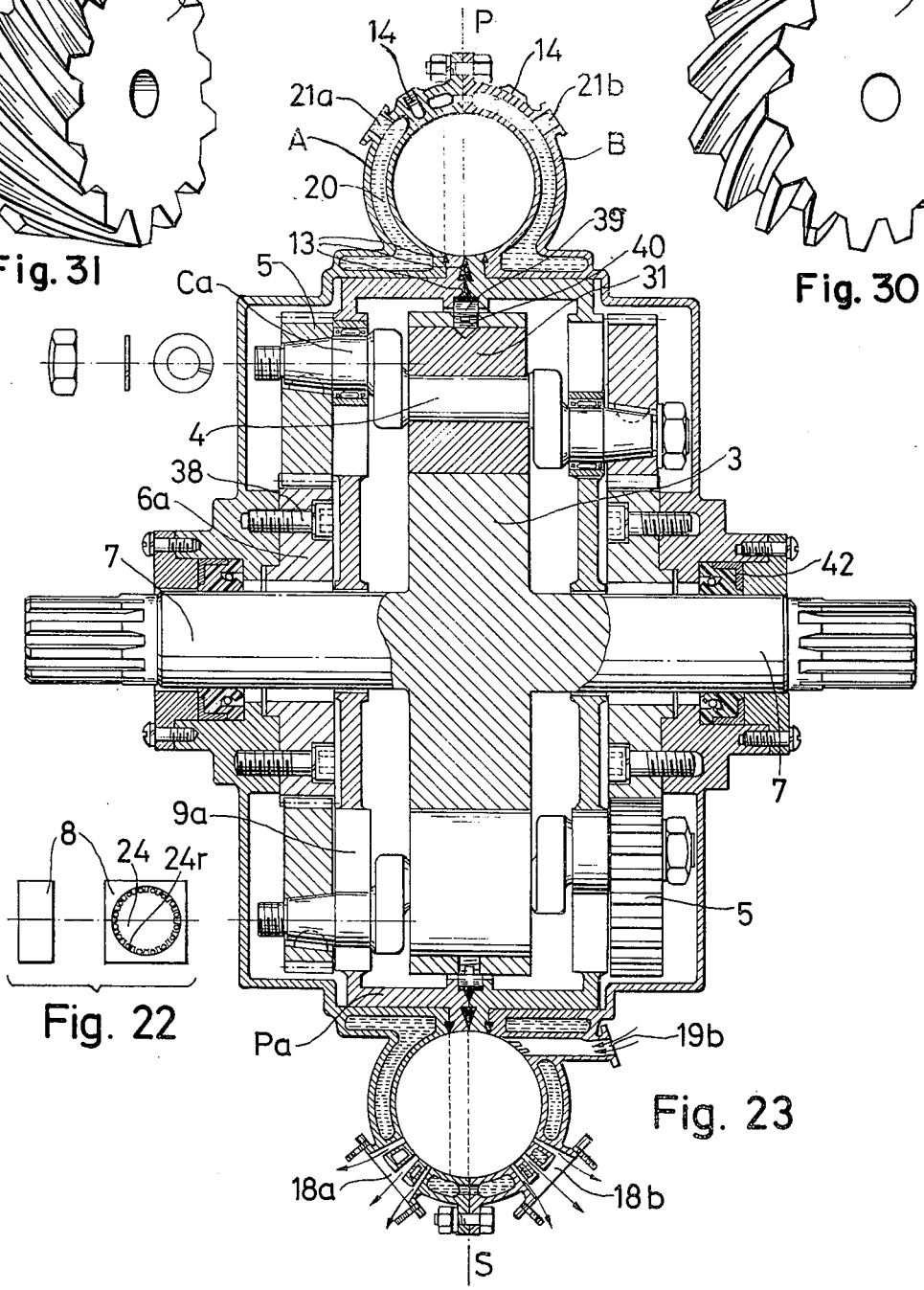
Fig. 22
Fig. 23

ROTARY CYCLOIDAL CONTINUOUS TOROIDAL CHAMBER INTERNAL COMBUSTION ENGINE

This is a continuation, of application Ser. No. 450,194, filed Mar. 11, 1974 and now abandoned.

SUMMARY OF THE INVENTION

The combustion chamber of the rotary internal combustion engine of the present invention is formed of two housings. Each housing is in the shape of a half torus. The toroidal shape is best defined as that generated by a circle, the center of which describes a circumference around an imaginary axis contained in the same plane as the circle, said toroidal shape being uniform and continuous through out the total dimension of its generatrix and defining the inner portions of the two housings. Each housing is defined as that structure defined by dividing said toroidal space at the plane which passes through the circumference of the generatrix of the chamber. At least four pistons are fitted in said chamber. Each piston has the shape of a portion of a torus. The pistons are arranged for cooperative association within said chamber.

The gas-tightness of the combustion chamber is secured by means of four surfaces which fit around the pistons; two fixed and two moving. The two fixed surfaces are formed by the interior portion of two semi-toroidal housings which make up what may be called the engine block. The plane which passes through the circumference generatrix of the chamber will hereinafter be called the "central symmetry plane." The two moving surfaces are provided by two hat-shaped, discs or plates, which rotate in contact with each other. The central symmetry plane which divides the two housings passes through the plane of contact of the two plates. These two straight and parallel plates, which function to provide mobile closure of the chamber, are provided with labyrinth rings, fitted on each side of the central symmetry plane flush with the interior surface of the toroidal chamber. There are two other planes parallel to the central symmetry plane which represent the thickness of the two flanges of said plates. The two hat-shaped discs fit sealably within a slot in the smaller diameter portion of the torus. The two housings are bolted together at the portion of larger diameter. The flanges of the two plates, where they enter the chamber are of a "half round" shape peripherally i.e., they complete the part of the circumference corresponding to the circle of the toroidal chamber which is interrupted by the said plate flanges and, thus ensure the gas-tightness and seating the piston rings. The four pistons are firmly mounted on the flanges of these two plates or discs. Two of the pistons are secured to the flange of one plate; and two to the flange of the other plate. Adjacent pistons are mounted on different plates; i.e., one to one plate, and the following one to the other plate. In this engine the number of pistons is even.

The engine flywheel is located in the central space formed by hat-shaped concavities in the two plates. the drive shaft is connected to the flywheel. Two crankshafts are located off the axis of the flywheel at an angle of 180 ° to each other (diametrically opposed). The flywheel acts as a bearing for the crankshafts, since the latter are contained within and rotate with the flywheel.

The flywheel, as stated, is situated in the center of the space formed by the two plates, and crank pins of the crankshafts pass through at least one of the hat-shaped plates. In the embodiment described, the crankshafts have crank pins on both sides of the flywheel. Thus each crankshaft has a crank pin which passes through each hat-shaped plate. Both crankshafts are provided with shoes which fit into rectangular openings in the plates, through which the crank pins pass. These rectangular openings serve as slideways on which the shoes slide.

The outer end of each crank pin is provided with a gear which meshes with a gear wheel secured to and centered in the housing of each corresponding side. When the flywheel turns, the crankshaft gears mounted in the flywheel rotate on the gear wheel fixed to the housing, so that the geometric axes of the crankshaft cranks each describe an epicycloid figure when the gear wheels are located inside the circles of rotation of the crankshaft gears and a hypocycloidal figure when the gear wheels are located outside the circle of rotation of the crankshaft gears (ring gear). Each respective slideway gives a reciprocating motion to its relative plates as the crankshafts rotate in the flywheel, giving rise to a cycloidal movement of the pistons in accordance with the relative positions of the two crankshafts, and thereby perform the processes of intake, compression, ignition, expansion, exhaust and scavenging of the residual gases.

The interchange of power between the plates fitted with pistons (pressure of combustion and kinetic energy) and the flywheel, is brought about due to the crankshafts being mounted on the flywheel, the flywheel acting as a mobile bearing for the crankshafts, and since the flywheel is connected on one side to the driving torque by means of the crankshaft and the two plates, and on the other side by means of the drive shaft to the resistance torque, the result is that the active forces of the reciprocating parts produce a working effect on the flywheel.

The shoes which slide on the slideways can be thought of as connecting rods of infinite length.

For a better understanding of the invention reference is made to the accompanying drawings presented, by way of example only, and in which:

BRIEF DESCRIPTION OF THE DRAWINGS

FIG. 2 shows, in section, an exploded first housing portion of the engine of FIG. 1;

FIG. 3 shows a pair of diametrically opposed pistons appropriately configured for utilization in the preferred embodiment of the instant invention as configured for operative association with the housing portion of FIG. 2;

FIG. 4 shows, in further detail one of the hat-shaped plates of the present invention with pistons attached, exploded to facilitate explanation;

FIG. 5 shows the preferred flywheel and associated crankshaft of the present invention;

FIG. 6 shows a second pair of diametrically opposed pistons attached to the perimeter of a second hat-shaped plate;

FIG. 7 shows, in section, a second housing portion of the basic engine, which portion in conjunction with the housing portion of FIG. 2 may be considered the basic engine block of the invention;

FIG. 13 shows a second portion of an operation cycle;

FIG. 14 shows a third portion of an operation cycle;

FIG. 17 shows a sixth portion of an operation cycle;

FIG. 18 shows a seventh portion of an operation cycle;

FIG. 21 is a schematic representation of a characteristic of the basic engine of the present invention;

FIG. 22 shows a shoe in plane and in elevation suitable for incorporation in one housing of the engine of the instant invention, the shoe being provided with a needle bearing;

FIG. 23 shows in an enlarged scale relative to FIGS. 1-20, in section, an assembled engine with the various components thereof shown in detail;

FIG. 27' demonstrates that the plane of FIG. 27 is tangent to the one of the two faces of the grooves shown in FIG. 27;

FIG. 29 shows a cross sectional view of one half of the housing in which the gear is in the form of a ring with internal teeth.

FIG. 30 shows a perspective view of gears having helical teeth.

FIG. 31 shows a perspective view of gears having herringbone teeth.

DETAILED DESCRIPTION OF THE PREFERRED EMBODIMENT

Figure 1:
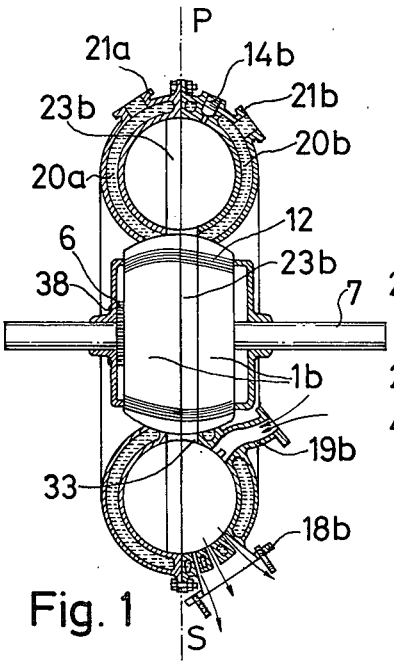
FIG. 1 shows, in section along $Y_3$–$Y_5$ of FIG. 8, the general configuration of a preferred embodiment of the asembled engine of the present invention.
Figure 9:
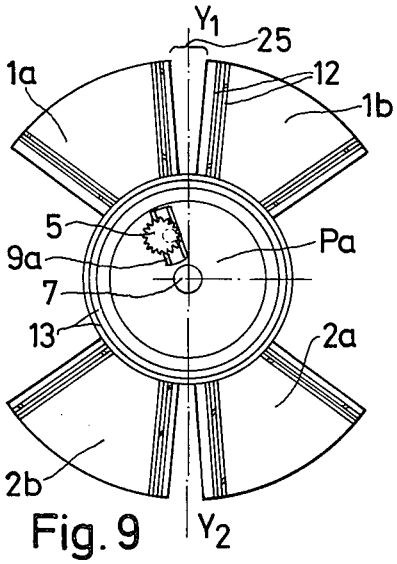
FIG. 9 shows details of the four pistons of the basic engine of the present invention provided with suitable compression rings, two of the pistons being shown in the position of closest proximity in accordance with a principle of operation of the present invention.

As previously stated, the description up to this point refers to the basic engine which is made up of fourteen parts. The parts of the basic engine are as follows (the numerals or capital letters after each part refers to reference designators in the drawings):

two Housings, A and B; Housing A, FIG. 2, housing B, FIG. 7.

two Discs or plates, P*a* and P*b;* FIG. 3.

four Pistons, 1*a*, 1*b*, 2*a*, 2*b;* FIG. 9 mounted on plates P*a* and P*b*.

one Flywheel, 3; FIG. 5.

one Crankshaft, 4; FIG. 5. Left hand crank 4C*a;* right hand crank 4C*b*.

one Gear, 5; FIG. 5. Mounted on one end of the crankshaft 4.

one Gear wheel, 6; FIG. 2. Fixed on housing A.

two Shoes, 8; FIG. 22 of crankshafts 4.

The ports in housing A and B are not detailed as parts. The ports are merely openings in the housings.

If an attempt were made to balance the single crankshaft basically required for this engine by means of a fixed mass, as is usually the case with engines provided with crankshafts, it would only be possible to do so approximately, because a crankshaft being an eccentric mass, its center of gravity varies continually as it rotates within the uniform mass of the flywheel. At best, only an approximate balance is achievable by means of a fixed mass.

For this reason, placing another exactly similar crankshaft in the flywheel, with the center of rotation diametrically opposed (at 180°) and at the same distance from the center of the flywheel, provides a balance in which the circular imbalance contributed by one crankshaft is balanced by an equal but opposite imbalance contribution by the other. If instead of having two crankshafts diametrically opposed, three are placed in a staggered position (at 120°between each) they will still be mathematically balanced, as also if four crankshafts are fitted at 90°between each. As will be appreciated, the number of crankshafts, if suitably placed, will not alter the operation or basic cycle of this type of engine and the number, up to two, serves principally, to balance the engine. More than two will reduce the specific load. Further, instead of a single gear wheel fixed to one housing, two may be used, one on each housing, and consequently, the crankshafts may be fitted with a gear at each end, each gear running on the gear wheel of the respective housing. This promises better distribution of the driving efforts, dynamic and static balance and a lower work load. It will be appreciated that if, for example, four crankshafts are available, with a gear at each end, four gears will run on each of the two gear wheels of the housings.

OPERATION

In Housings A and B there are several openings or ports which are to be used for the four operational strokes of this engine: intake, compression, ignition-expansion, exhaust and scavenging of the residual gases. As will be appreciated, apart from the four strokes, mention is made of scavenging or ventilation which does not comprise a motion or accessory stroke in the motion of the pistons, but this is carried out following commencement of the exhaust stroke, as will be detailed later.

Figure 28:
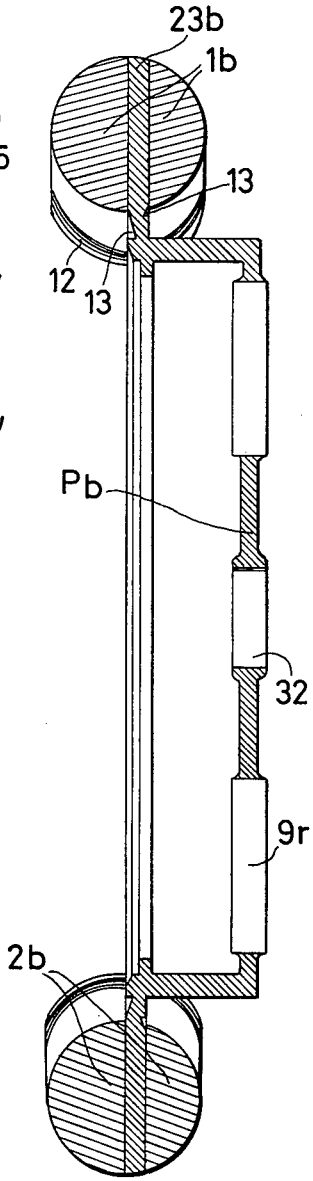
FIG. 28 shows a diametrical section of a plate through the centers of the pistons associated therewith.
Figure 26:
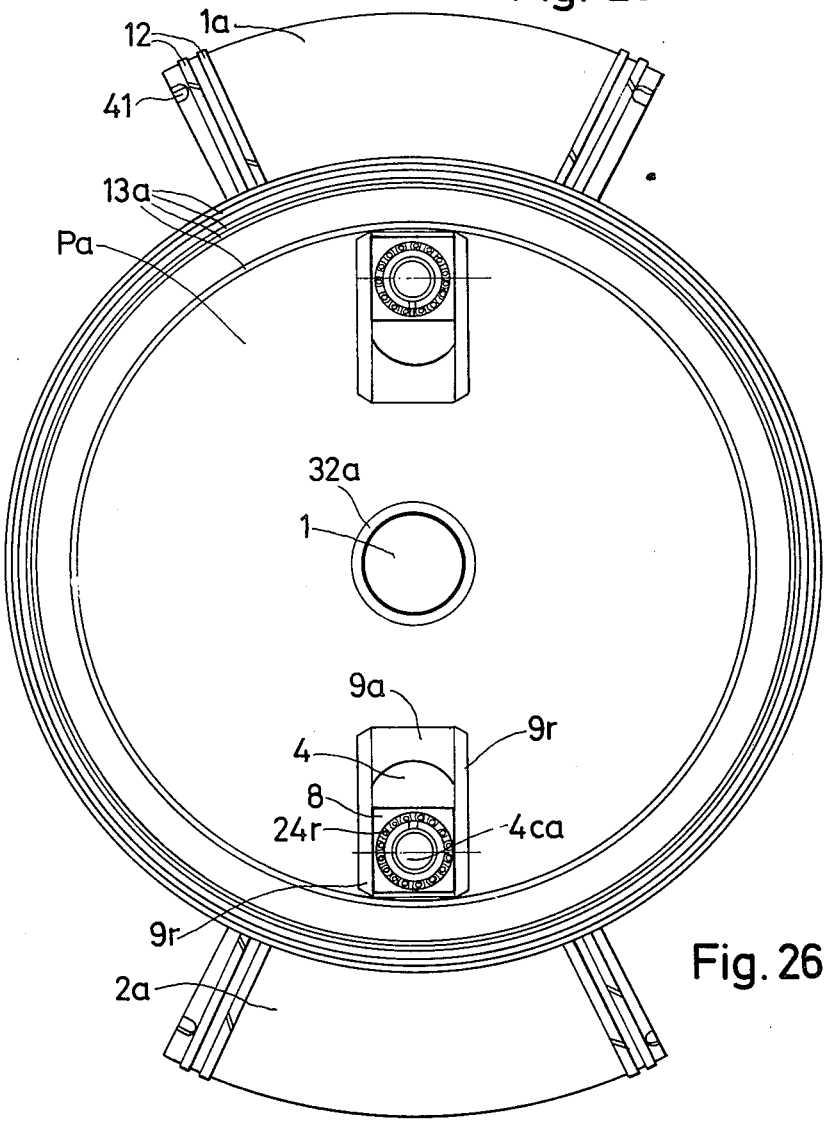
FIG. 26 shows mounting of the preferred pistons and the provision of gaps therein for uncovering the ignition opening or openings to facilitate entry of gas to appropriate spark plugs.

FIG. 1 shows the basic engine arrangement of this invention with a section showing the flanges 23*a* and 23*b* of the relative plates which in their periphery are of half round shape 33 and support the corresponding pistons. In FIG. 2 housing A is shown provided with a gear wheel 6. In FIG. 3 can be seen the two pistons 1*a* and 2*a*, diametrically opposed and fixed to plate P*a*. Plate P*b* is shown with the corresponding pistons 1*b* and 2*b* in FIG. 6; gear 5 of the crankshaft 4 is shown on FIG. 5. The plates P*a* and P*b*, as shown in the detail of FIGS. 26 and 28 are provided with an opening 9*a*, radially elongated, with two flats or surfaces 9*r* well polished and perpendicular to the face of the plate P*a*, FIG. 26, between which the rectangular shoe 8 slides; shoe 8 is mounted through its center hole 24 on each of cranks 4C*a* and 4C*b* of the crankshaft 4.

Figure 8:
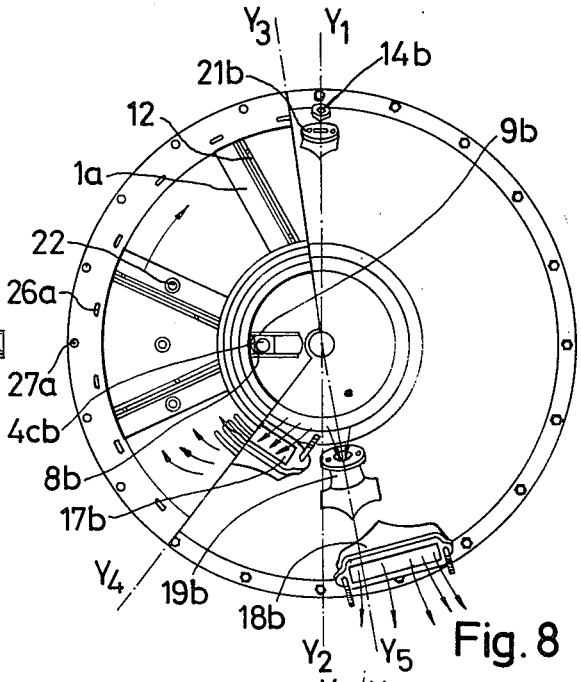
FIG. 8 shows, an along-axial view of the preferred embodiment of FIG. 1 with the combustion chamber cut away along $Y_3$–$Y_4$ to reveal internal details.
Figure 10:
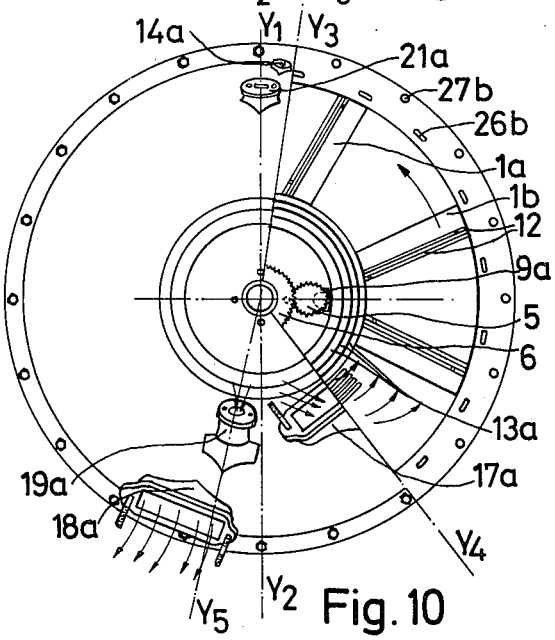
FIG. 10 shows, cut away along lines $Y_3$–$Y_4$ to show internal details, the same basic assembly as that, viewed from the other side, of FIG. 8 except that here are shown the gear and associated wheel integral with the housing portion.

FIG. 8 shows the engine cut away along $Y_3$-$Y_4$ of housing B, pistons 1*a*, 2*b* secured with bolts 22, and provided with the necessary compression rings 12 similar to those used for this purpose in conventional engines of the gasoline of diesel types, exhaust port 18*b*, scavenging port 19*b*, intake port 17*b* (partly cut away), slideway 9*b* and shoe 8*b*. Since basically only one gear 5 is necessary, there is none shown on this side of the engine in FIG. 8. FIG. 10 shows the same assembly looking from the other side and, cut away, along the same $Y_3$-$Y_4$ as in FIG. 8, except that in FIG. 10 gear 5 and wheel 6 are shown integral with the housing A.

FIG. 9 shows details of the four pistons 1*a*-2*a* and 1*b*-2*b* provided with rings 12 and mounted on two plates P*a* and P*b*, of which we only see plate P*a*. FIG. 9 also shows slideway 9*a*, gear 5 of the crankshaft and the engine shaft 7 integral with flywheel 3 (the flywheel is shown in FIG. 23). When the assembly of FIG. 9 is introduced into the housing A, gear 5 meshes with gear wheel 6, as in FIG. 10. As the flywheel rotates, the gear 5 rotates on wheel 6 which serves as a track. With the external-tooth gear wheel 6 shown in FIG. 10, the crank pin in the gear 5 describes an epicycloid. The center line $Y_1$–$Y_2$ in FIG. 10 coincides with the opening 14 (FIGS. 8 and 10) for the spark-plug in the theoretical position of ignition and serves as a reference line for the relative arrangement of the three classes of ports 17, 18 and 19.

Figure 12:
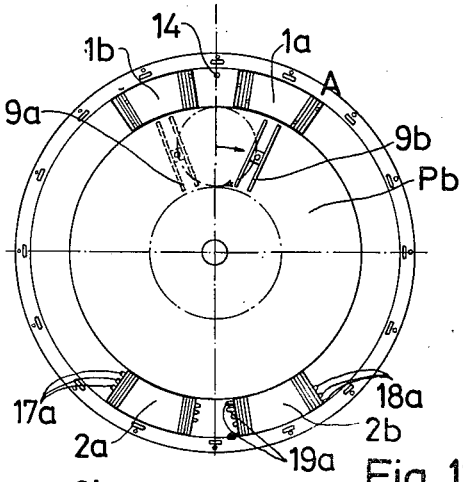
FIG. 12 shows a first portion of an operation cycle.

FIG. 12 shows the assembly of FIG. 9 mounted on housing A. In FIG. 12 pistons 1*a* and 2*a* are integral with the plate P*a* (not shown). The slideway 9*a*, shown in dotted lines, is on plate P*a*, and slideway 9*b* is on plate P*b*.

In the basic engine, containing the minimum possible number of four pistons, gear wheel 6 is double the diameter of gear 5 on the crankshaft crankpin; i.e. the ratio of 2:1.

Referring again to FIG. 9, we see that the assembly to be fitted into the two housings has the pistons in the position of closest proximity (1*b* and 1*a* ) and, diametrically, pistons 2*b* and 2*a* in a corresponding position of proximity. Due to the arrangement of the pistons on the two plates, pistons 2*a* and 1*b* and, diametrically, pistons 1*a* and 2*b* are at maximum spacing. The position shown in FIG. 9 corresponds to the moment of firing. Upon firing the gases compressed between the pistons 1*a* and 1*b* expands causing pistons 1*a* and 1*b* to separate. As stated, each plate P*a* and P*b* is connected to the crankshaft by means of corresponding slideways 9*a* and 9*b* and shoes 8*a* and 8*b*. On ignition, the pistons 1*a*, 2*a*, 1*b*, 2*b*, cause the crankshafts 4*ca* and 4*cb* (FIG. 23) to rotate, so that gear 5 turns under its own power, on gear wheel 6, which serves as a track and draws flywheel 3 with it. The combined motions give rise to the desired composite cycloidal motion of the crank pins resulting in reciprocal motion of the crankshaft supported by the turning motion (pull) of the flywheel. The result is as follows:

a. since the timing crankpins 4C*a* and 4C*b* (FIG. 23) are in opposition (at 180°, the relative slideways transmit a turning torque to crankshafts 4, so that when gear 5 turns on gear wheel 6, the whole assembly of flywheel-crankshaft-plates-pistons is forced to rotate on gear wheel 6;

b. since the motion of each crankpin is epicycloidal the slideway of plate P*b* deducts the advance caused by gear 5 on gear wheel 6, from the amount given by the epicycloidal motion in the opposite direction to the rotation of the flywheel;

c. the slideway of plate P*a* adds the advance produced by the same cycloidal phenomemon to plate P*a*. FIG. 13 shows that when the flywheel has moved 45°, gear 5 has rotated 90°. Cranks 4C*a* and 4C*b* of the crankshaft will be in the position indicated in the figure. A similar analysis can be done in which the gear 6 has internal teeth as shown in FIG. 29. In that case, the motion of the crankpins is hypocycloidal rather than epicycloidal.

Figure 11:
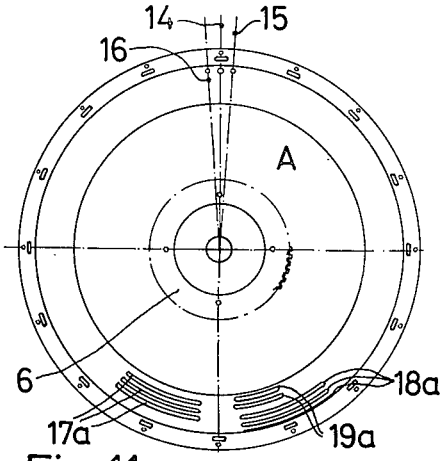
FIG. 11 shows in outline one housing portion stripped of pistons and associated mechanisms.

FIGS. 11 to 20 trace the relative motions of the various components in a full rotation of the flywheel. FIG. 11 represents housing A, gear wheel 6 centered relative to the turning axis of the engine, and spark-plug opening 14. Ignition advance can be achieved using additional offset ports 15 or 16 as spark-plug locations depending on the direction of rotation of the engine. For unidirectional engine rotation only one spark-advance port is needed.

It is possible to make the engine rotate in either direction, but for purposes of description, rotation in the clockwise direction indicated by the arrow in FIG. 12 is assumed. FIG. 12 shows toroidal semi-chamber A including, spark-plug opening 14 then, continuing clockwise, the exhaust port 18, the scavenging port 19 adjacent the exhaust port 18, and the intake port 17.

It is important to an understanding of the engine to realize that both ends of each piston are active. After the leading face of a piston completes its function, for example, it moves into a position such that its trailing face assumes the function previously done by the trailing face of the piston just ahead of it. Thus the four pistons effectively divide the toroidal combustion chamber into four regions in which the functions can be analogized to similar functions in a conventional engine.

Since the engine shaft is integral with the flywheel any reference to rotation of the shaft is equivalent to rotation of the flywheel.

The following discussion with reference to FIGS. 12 through 20 traces the activity in each of the four regions of the toroidal combustion chamber through a single revolution of the flywheel:

FIG. 12.-1*b*-1*a*: combustion, 1*a*-2*b*; end of expansion and beginning of exhaust; 2*b*-2*a*; end of exhaust and of scavenging of gases, and beginning of intake, 2*a*-1*b*; beginning of compression.

FIG. 13.-1*b*-1*a*: expansion, 1*a*-2*b*; exhaust, 2*b*-2*a*, intake; 2*a*-1*b*, compression.

FIG. 14.-2*a*-1*b*: combustion; 1*b*-1*a*, end of expansion and beginning of exhaust; 1*b*-2*b*, end of exhaust and of scavenging of gases and beginning of intake; 2*b*-2*a*, beginning of compression.

Figure 15:
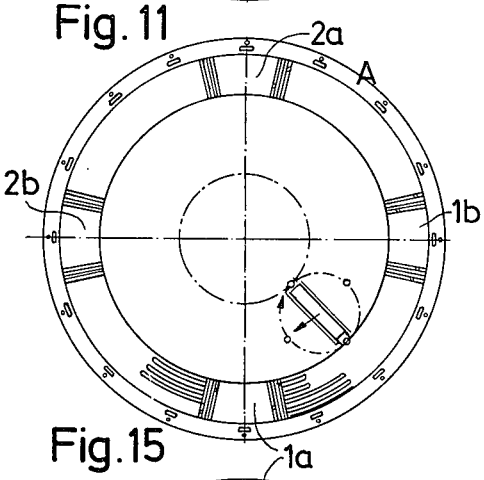
FIG. 15 shows a fourth portion of an operation cycle.

FIG. 15.-2*a*-1*b*: expansion; 1*b*-1*a*, exhaust; 1*a*-2*b*, intake; 2*b*-2*a*, compression.

Figure 16:
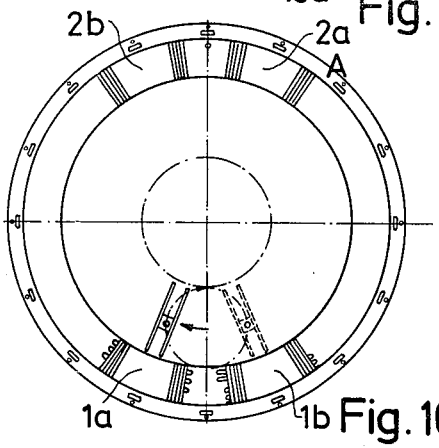
FIG. 16 shows a fifth portion of an operation cylce.

FIG. 16.-2*b*-2*a*: combustion; 2*a*-1*b*, end of expansion and beginning of exhaust; 1*b*-1*a* end of exhaust and of scavenging of gases and beginning of intake; 1*a*-2*b*, beginning of compression.

FIG. 17.-2*b*-2*a*: expansion; 2*a*-1*b*, exhaust 1*b*-1*a*, intake; 1*a*-2*b*, compression.

FIG. 18.-1*a*-2*b*: combustion; 2*b*-2*a*, end of expansion and beginning of exhaust; 2*a*-1*b*, end of exhaust and of scavenging of gases and beginning of intake; 1*b*-1*a*, beginning of compression.

Figure 19:
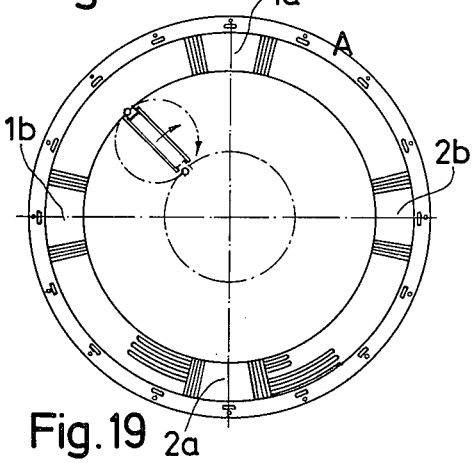
FIG. 19 shows an eighth portion of an operation cycle.

FIG. 19.-1*a* -*l* -2*b*: expansion; 2*b*-2*a*, exhaust; 2*a*-1*b*, intake; 1*b* -1*a*, compression.

Figure 20:
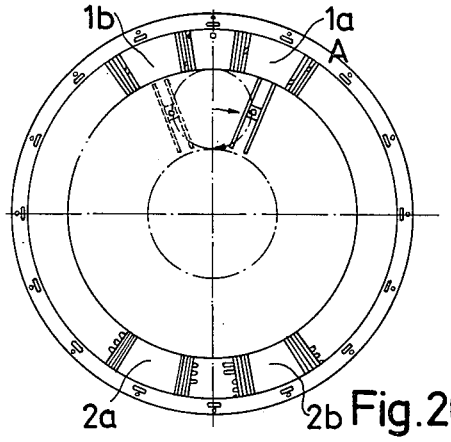
FIG. 20 is identical to FIG. 12, showing the completion of the operating cycle.

FIG. 20.-Identical to FIG. 12.

The kinematic study of the above-mentioned figures shows us that the pistons rotate at the same average speed as the flywheel and its shaft, and in one rotation of the engine shaft four explosions occur. Therefore, this four piston engine is, in so far as the number of explosions is concerned, equivalent to a conventional eight cylinder engine (Beau de Rochas cycle).

The rotary motion of this engine gives rise to a centrifugal scavenging phenomenon which helps to carry out the fourstroke cycle. The centrifugal scavenging phenomenon does not occur in straight-line chamber engines. Also, the arrangement of its parts and the way the parts function together make this engine different from any other rotary engine.

The centrifugal scavenging phenomenon is described with reference to FIG. 11. As the engine rotates, centrifugal force tends to move fresh and burned gases toward the portion of the chamber of largest diameter. Consequently, when the piston begins to uncover the exhaust port 18*a*, the burnt gases are urged through ports 18*a* due not only to their inherent kinetic energy resulting from heat and pressure but also due to the centrifugal force acting on them. The outgoing energy of the exhaust gases causes a partial vacuum in the chamber. While the burnt gases are being exhausted through port 18*a*, the piston uncovers scavenging port 19*a* located in the region of smallest diameter and allows fresh air to enter at atmospheric pressure. Centrifugal force aids the entry of air through the scavenging port thus further clearing burned gases from the chamber. As the piston continues to move clockwise, the intake of carburetted gases is carried out by a piston uncovering port 17*a* and the following piston closing the exhaust and scavenging ports. The intake port 17*a* is located in the portion of smallest radius of the torus (see FIG. 10), adjacent to the "half rounds" 33 (FIG. 1) of the plates P*a* and P*b*. The centrifugal force of gases in the combustion chamber also aids charging during the intake stroke. Although the arrangement of the exhaust, scavenging and intake ports described in the preceding improves the operation and the power output of the engine, it is to be understood that the engine will operate if scavenging port 19*a* is dispensed with. Improved operation is obtained if dual intake outlet and scavenging ports are arranged; i.e. in both housings.

FIG. 23 gives a practical example of the engine of this invention. In this figure it can be seen that the chamber is completely closed by the two housings A and B, at the smallest diameter of the torus by the two plates P*a* and P*b*. The labyrinths 13 which ensure the gas tightness of the junctions of the plates with each other and with the housings A and B are also shown. The flywheel 3 is shown in section containing two crankshafts 4 each provided with gears 5 at each end; two fixed gear wheels 6, (*a* and *b* ) one on each housing and shaft 7. It can also be seen that the engine is provided with exhaust ports 18*a* and 18*b* in each housing. The engine is provided with a single scavenging port 19*b* in housing B, as stated previously, but it may also be provided with another 19*a* in housing A (FIG. 11 and 12). It can also be seen that the exhaust ports 18 (*a* and *b*), scavenging ports 19 (*a* and *b*) and intake ports 17 (*a* and *b*) have longitudinal windows or grooves, in the direction of the motion of the pistons, these ports are grid shaped to prevent the rings 12 from fouling the edges of the ports. The seals 42 prevent losses of lubricating oil.

As shown in FIG. 22, shoe 8 may be provided with needle bearngs 24*r* in order to reduce friction, both at the opening for the crank of the crankshaft and at the surface which slides on the flats 9*r* of the relative slideway.

Figure 24:
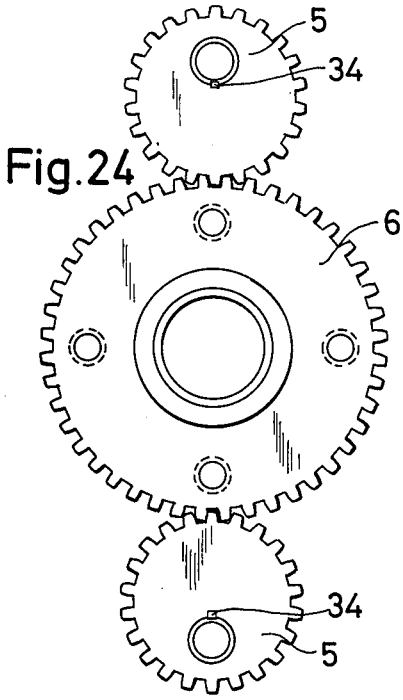
FIG. 24 shows the meshing planetary gears of the crankshafts 5 and the wheel 6 of FIG. 23.

FIG. 24 shows gear 5 as seen from the side of housing A with keys 34 meshing with gear wheel 6. Gear wheel 6 is fixed to its housing by means of bolts 38 (FIG. 23). Gear 5 and gear wheel 6 may have straight axially directed teeth as shown in FIGS. 2, 3, 5, 9, 10, 23 and 29 or they may have helical teeth as shown in FIG. 30 or they may have herringbone teeth as shown in FIG. 31.

The pistons may be provided with gaps 41 (FIG. 26) for the purpose of uncovering without delay the ignition opening or openings, facilitating in this way the entry of the gas to the spark-plugs and reciprocally the subsequent exit of the spent fuel.

Figure 27:
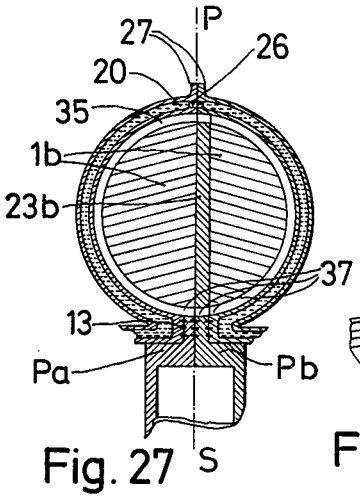
FIG. 27 shows a section of the engine through a normal plane of any given piston.
Figure 27:
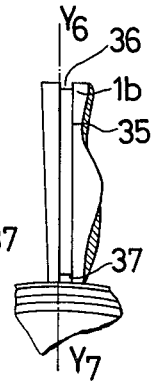

FIG. 27 shows a section of the engine through a normal plane $Y_6$–$Y_7$ (FIG. 27′) of any piston. This plane is tangent to one of the two faces of groove 36, FIG. 27′. The grooves 36 carry the rings 12 when the pistons are mounted on the flanges 23*a* and 23*b* of the plates P*a* and P*b* carrying them. The ring seats on both walls of he groove of the piston (1 and 2, *a* and *b*), and at the same time on the wall of the groove of the flange (23*a* and 23*b*) as is indicated in FIG. 27, by numeral 37 directed to three point on the same plane. Therefore, the ring 12 (FIG. 28) is seated around the circumference of the combustion chamber and the periphery of the two plates P*a* and P*b* and also, in the side faces of the grooves, at point 37.

FIG. 28 shows a diametrical section of plate P*b* through the center of the pistons 1*b* and 2*b*. The grooves of the labyrinths 13 can be seen (in this case only one groove at each side is shown to allow them to be illustrated in larger size, since the number of labyrinth seals depends on the extent of sealing or hermeticity it is desired to attain). Two sliding surfaces 9*r* of the slideways can also be seen.

Figure 25:
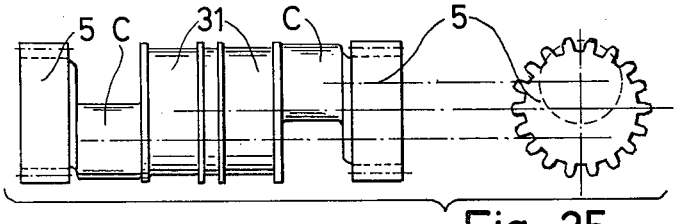
FIG. 25 shows, schematically, an operating characteristic of a crankshaft of the engine.

The crankshaft C, as will be appreciated in FIG. 25, can be integral with the gears 5, and be provided with grooves 31 for needle, ball or roller bearings, etc.

The preceding description of the engine has been directed to a basic configuration using the minimum number of parts with which it is possible to build it. The characteristics of this engine allow the horsepower to be increased or smoother operation to be obtained by multiplying some of the components. For example, the following table gives an idea of the possibilities of this engine. The number of spark plugs ("spark plug"means the areas of the chamber where ignition may be carried out. Several spark plugs may be used at each such point.) is equal to the number of pistons divided by four; the same applies to the three classes of ports; 17, 18 and 19.

In this table, the keys are as follows:

$T_1$, number of pistons.
$T_2$, number of spark plugs.
$T_3$, number of explosions during each turn of the flywheel.
$T_4$, Ratio of gear wheel 6 to crankshaft gear 5.

| $T_1$ | $T_2$ | $T_3$ | $T_4$ |
|---|---|---|---|
| 4 | 1 | 4 | 2:1 |
| 8 | 2 | 16 | 4:1 |
| 12 | 3 | 36 | 6:1 |
| 16 | 4 | 64 | 8:1 |

When the ratio of gear wheel 6 to crankshaft gear 5 is greater than 2:1, gear wheel 6 may be made with interior teeth as shown at 60 in FIG. 29 and, consequently, gear 5 is then arranged to engage internally (on the concave side) of the gear wheel. Then the center of rotation of the crankshaft on the flywheel is then situated at the least possible distance from the flywheel shaft. Further, in arranging the meshing of gear 6–5 in this way, the curve described by crank 4 of the crankpin of the crakshaft is hypocycloidal.

In FIGS. 1, 7, 23, 27 the numeral 20 indicates the water cooling arrangement passing via ports **26*a* and 26*b* (FIGS. 8 and 9) from one chamber to another. Water inlets and outlets 21*a* and 21*b* are shown in FIGS. 1, 8, 10 and 23.**

I claim:

1. In a rotary internal combustion engine comprising:

a. a housing forming a toroidal-shaped combustion chamber containing a continuous circular slot at the minimum diameter of said toroidal shaped combustion chamber;

b. a plurality of hat shaped circular plates having concavities, the periphery of said circular plates slideably engaging with and sealing said slot, the center of said plates containing a concentric circular hole adapted to the passage therethrough of an engine shaft, said plates being adapted to rotational motion independently of each other, the concavities of said hat shaped circular plates being assembled facing each other whereby a central disc-shaped space is formed;

c. a disc-shaped flywheel disposed within and coaxial with said central disc-shaped space;

d. two engine shafts extending axially outward in opposite directions from said flywheel and thence through said concentric circular holes, the outer ends of said engine shafts being adapted to the transmission of power to a load;

e. one crankshaft journal bearing in said disc-shaped flywheel for each said circular plate, said journal bearings having axes parallel to said flywheel axis and being located at equal radii from the axis of said flywheel and at an angle from each other of 360° divided by the number of said circular plates;

f. two pistons attached to the perimeter of each said circular plate at opposed locations, said pistons being shaped to conform to the inside shape of said toroidal-shaped combustion chamber;

g. piston rings on each end of each of said pistons, said piston rings being in slideable sealing engagement with the walls of said toroidal-shaped combustion chamber;

h. an essentially rectangular slideway, having its longer side in the radially direction, in each of said circular plates;

i. a slideable shoe containing a transverse hole adapted to radial slideable displacement in each of said rectangular slideways;

j. a crankshaft having a journal bearing and at least one crank arm mounted in each crankshaft journal bearing;

k. a crankpin bearing on the inner end of each crankpin, said crankpin bearing being in slideable engagement with the said hole in said slideable shoe;

l. an eccentric gear on the outer end of each crankpin, said gear being eccentric with said crankpin but concentric with said crankshaft journal; and m. at least one stationary gear in cooperative mesh with each of said eccentric gears, said stationary gear having a pitch radius essentially equal to the pitch radius of one eccentric gear as measured from said journal bearing axis times the number of said circular plates.

2. The rotary internal combustion engine as recited in claim 1 wherein the teeth on said stationary gear are directed outward from its center whereby each of said crankpins executes an epicycloidal motion as said eccentric gear rotates in mesh around the outside of said stationary gear.

3. The rotary internal combustion engine as recited in claim 1 wherein said stationary gear is a ring gear having teeth directed toward its axis whereby each of said crankpins executes a hypocycloidal motion as said eccentric gear rotates in mesh around the inside of said stationary gear.

4. The rotary internal combustion engine as recited in claim 1 further comprising:

a. one spark plug in said housing for each whole multiple of four pistons;

b. one intake port in said housing for each whole multiple of four pistons;

c. one scavenging port in said housing for each whole multiple of four pistons; and d. one exhaust port in said housing for each whole multiple of four pistons.

5. The rotary internal combustion engine as recited in claim 4 wherein each of said pistons contains a gap in its perimeter between the outer piston ring on each end of said pistons and the end of said pistons, said gap being in the same radial position as said at least one spark plug, whereby a space is created for combustion to begin adjacent to said spark plug before the end of said piston rotates clear of said spark plug.

6. The rotary internal combustion engine as recited in claim 1 wherein said eccentric and stationary gears have spur teeth.

7. The rotary internal combustion engine as recited in claim 1 wherein said eccentric and stationary gears have helical teeth.

8. The rotary internal combustion engine as recited in claim 1 wherein said eccentric and stationary gears have herringbone teeth.

9. In a rotary internal combustion engine of the type having a continuous toroidal combustion chamber, the improvement comprising:

a. two fixed juxtaposed housings forming an engine block;

b. a toroidal chamber disposed along the internal periphery of said block;

c. two rotatable juxtaposed plates forming a cavity within said block and coaxial therewith;

d. flanges on said plates;

e. pistons, in an integral multiple of flour, or circular toroidal section, joined alternately to said flanges and adapted to be displaced in said chamber;
f. a shaft extending through said cavity and said engine block;
g. a flywheel secured to said shaft and housed in said cavity;
h. at least one crankshaft disposed within said flywheel;
i. at least one angularly disposed crank having at least one crankpin thereon on said crankshaft;
j. shoes slidably engaging in radially extending openings in said plates and mounted on said crankpins;
k. a gear wheel secured about said shaft and to one said housing, said gear wheel having a diameter equal to half the number of said pistons multiplied by the diameter of said gear on said crankshaft;
l. at least one gear secured to each said crankpin and meshing with said gear wheel;
m. at least one intake port in said toroidal chamber whereby rotary unidirectional movement of said pistons successively opens and closes said intake port, said intake port being located in the area of smaller radius of said toroidal chamber, whereby the centrifugal force generated by the rotary motion of said piston augments the intake of combustion gases; and
n. at least one exhaust port in said toroidal chamber whereby rotary unidirectional motion of said pistons successively opens and closes said at least one exhaust port, said exhaust port being located in the area of large radius of said toroidal chamber, whereby the centrifugal force generated by the citcular motion of said pistons augment the expulsion of exhaust gases from said toroidal combustion chamber.

10. The rotary internal combustion engine of claim 9 further comprising:
a. piston rings on said pistons;
b. a plurality of curved slots defining said intake ports in said combustion chamber, said slots being separated by curved metal bars conforming on the inside of said combustion chamber, the long axis of said slots and intermediate bars being along the direction of piston motion and the radius of said arcs being equal to the radius from the axis of said toroid, whereby said piston rings are prevented from fouling the edges of said intake port; and
c. a plurality of curved slots defining said exhaust ports in said combustion chamber, said slots being separated by curved metal bars conforming on the inside of said combustion chamber, the long axis of said slots and intermediate bars being along the direction of piston motion and the radius of said arcs being equal to the radius from the axis of said toroid, whereby said piston rings are prevented from fouling the edges of said exhaust port.

* * * * *

UNITED STATES PATENT AND TRADEMARK OFFICE

CERTIFICATE OF CORRECTION

PATENT NO. : 4,026,249
DATED : May 31, 1977
INVENTOR(S) : Carlos Ayesta Larrea

It is certified that error appears in the above-identified patent and that said Letters Patent are hereby corrected as shown below:

Col. 11, Line 1 (Claim 9): "multiple of flour, or"

should read --multiple of four of--

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*